US006178793B1

(12) United States Patent
Emami

(10) Patent No.: US 6,178,793 B1
(45) Date of Patent: Jan. 30, 2001

(54) KEY HOLDER WITH DISTRIBUTED KEYS THROUGH TWO MOVING CYLINDERS

(76) Inventor: Shahriar Hojjati Emami, 949 W. Adams Blvd., Apt. #2, Los Angeles, CA (US) 90007

( * ) Notice: Under 35 U.S.C. 154(b), the term of this patent shall be extended for 0 days.

(21) Appl. No.: 09/365,647

(22) Filed: Aug. 6, 1999

(51) Int. Cl.[7] ..... A47G 29/10
(52) U.S. Cl. ..... 70/456 R; 206/37.1; 206/37.6
(58) Field of Search ..... 70/456 R, 457, 70/459, 460; 206/37.1, 38.1, 37.4, 37.5, 37.6, 37.7, 37.8

(56) References Cited

U.S. PATENT DOCUMENTS

| | | | | |
|---|---|---|---|---|
| 1,561,262 | * | 11/1925 | Blackstun | 70/456 R |
| 2,307,808 | * | 1/1943 | Segal . | |
| 2,505,987 | * | 5/1950 | Mullan | 70/456 R |
| 2,508,024 | * | 5/1950 | Hanna | 70/456 R |
| 2,547,340 | * | 4/1951 | Mullan | 70/456 R |
| 2,599,660 | * | 6/1952 | Poutinen . | |
| 2,625,814 | * | 1/1953 | Mullan | 70/456 R |
| 2,845,672 | * | 8/1958 | Molene | 70/456 R |
| 3,621,690 | * | 11/1971 | Whitcomb | 70/456 R |
| 3,968,669 | * | 7/1976 | Coleman | 70/456 R |
| 4,248,071 | * | 2/1981 | Kussoy | 70/456 R |
| 4,460,174 | * | 7/1984 | Perry | 70/456 R X |
| 4,576,839 | * | 3/1986 | Parren | 70/456 R X |
| 4,713,951 | * | 12/1987 | Ros | 70/456 R |
| 4,821,543 | * | 4/1989 | Scungio | 70/456 R |
| 5,058,405 | * | 10/1991 | Stillwagon | 70/456 R |
| 5,161,800 | * | 11/1992 | Parsons et al. | 70/456 R X |
| 5,179,748 | * | 1/1993 | Lipic | 70/456 R X |
| 5,457,976 | * | 10/1995 | Stillwagon | 70/456 R |
| 5,752,401 | * | 5/1998 | MacDonald | 70/456 R X |
| 5,816,458 | * | 10/1998 | Yonenoi | 70/456 X |

FOREIGN PATENT DOCUMENTS

| | | | | |
|---|---|---|---|---|
| 1064 405 | * | 5/1954 | (FR) | 206/37.6 |
| 2078499 | * | 1/1982 | (GB) | 70/456 R |
| 455 005 | * | 2/1949 | (IT) | 70/459 |

* cited by examiner

*Primary Examiner*—Lloyd A. Gall

(57) ABSTRACT

Two cylinders with two holes at the ends, gripping in each other. Two key rings are installed in these holes. The outer cylinder key ring moves through a split in the inner cylinder. The upper side of outer cylinder is used to attach a penholder to it. This key holder gives an excellent option to carry the keys without inconvenience inside the pocket. It is aligned with foot axis. It can be easily removed from the pocket and be used by moving cylinders together with easy access to whole keys. They can easily be separated from each other and replaced in the pocket.

2 Claims, 3 Drawing Sheets

Figure 2:
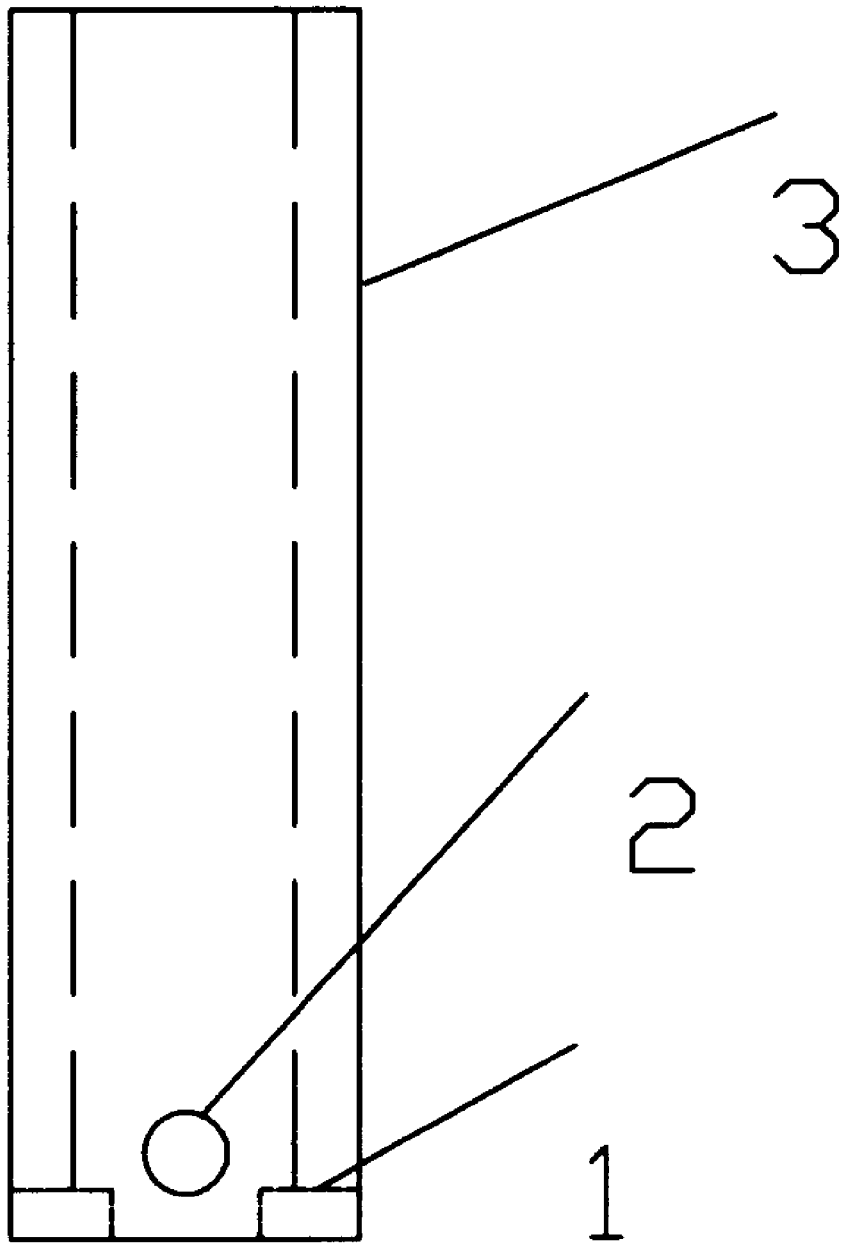

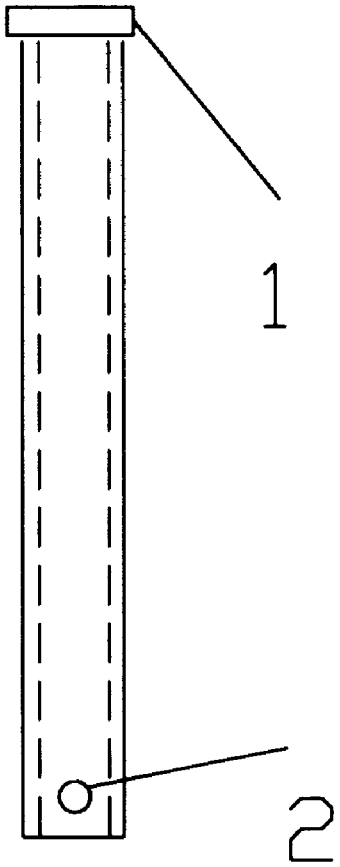
FIG. 1-A
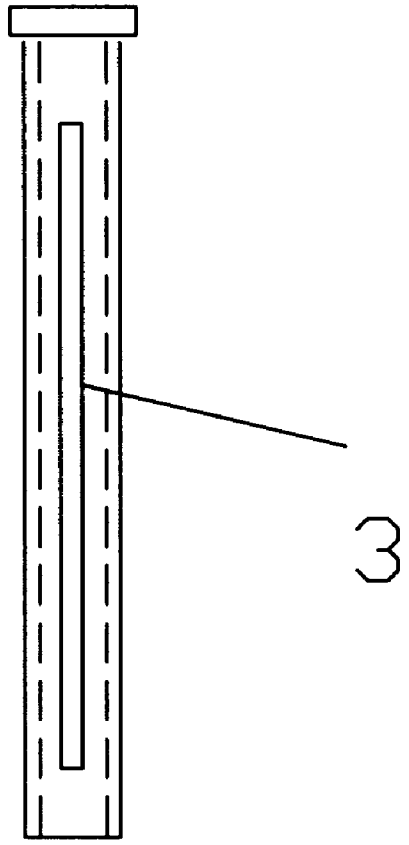
FIG. 1-B

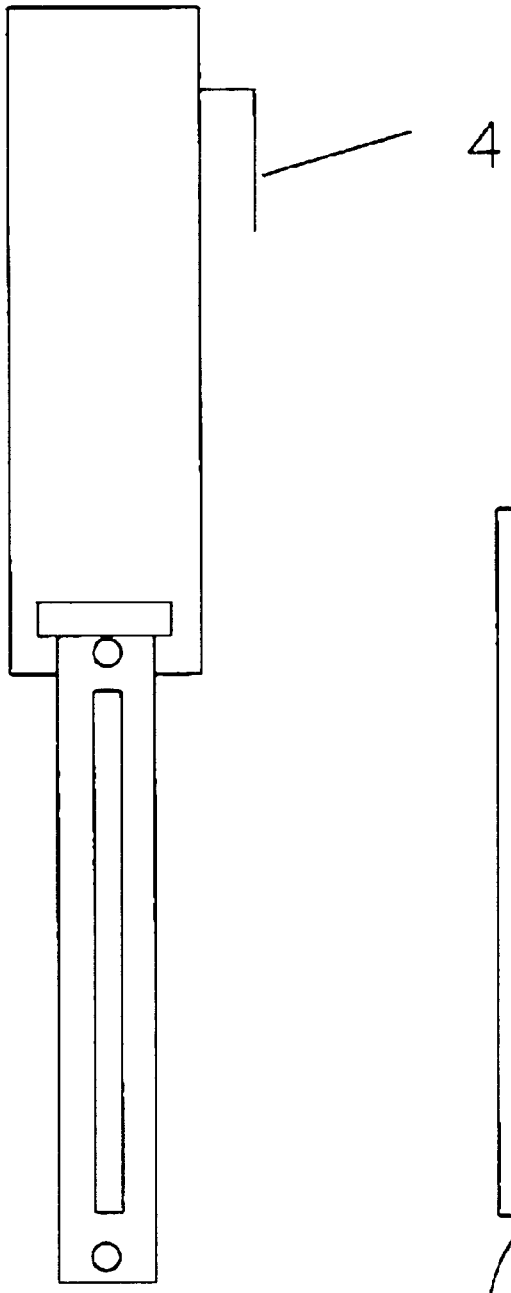
FIG. 3-A
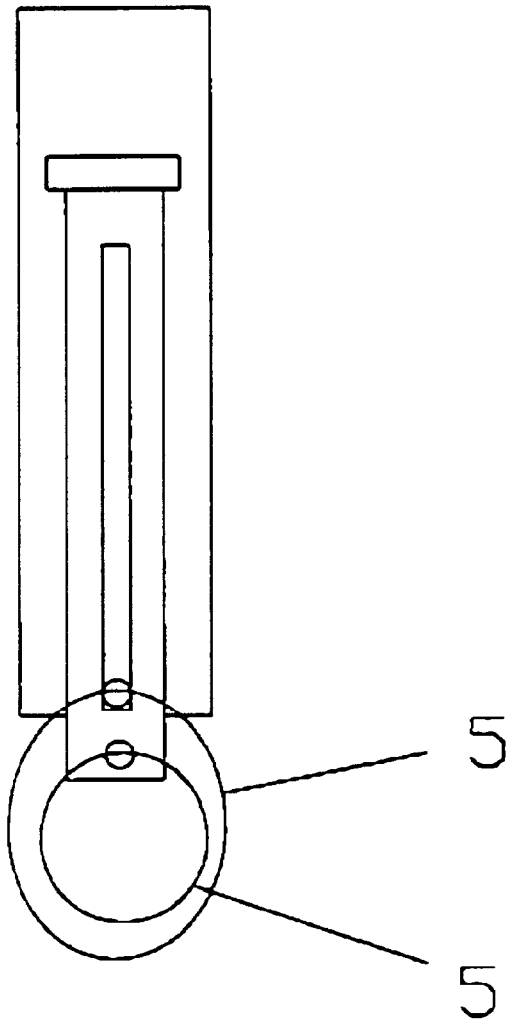
FIG. 3-B

KEY HOLDER WITH DISTRIBUTED KEYS THROUGH TWO MOVING CYLINDERS

CROSS-REFERENCE TO RELATED APPLICATIONS

Not applicable.

BACK GROUND

1. Field of Invention

This invention relates to distributing keys through two moving cylinders, which they are used as a key holder. A penholder can be attached to carry inside pocket.

2. Description of Prior Art

Different designs of key holders are available throughout the stores and supermarkets. However, most of people complain about large amounts of keys that they carry every day. These keys ar humped together either inside the trouser pockets or outside, attached to it.

Search at the U.S patent web page, shows 616 invention regarding to key holder, almost all of them different in a sense of attachments to key rings.

SUMMARY

In accordance with the present invention, moving cylinders' key holder, includes two cylinders with two holes at the end of each one with a split through the inner cylinder and a penholder in the upper side of outer cylinder.

OBJECTS AND ADVANTAGES

This invention has several advantages that make it unique.

(a) To provide a closure which can be produced in variety of size without requiring manufacturer to change the facility.

(b) To provide a closure which can be colored in several colors.

(c) To provide a closure which will provide easy way to install a penholder and carry it inside the pant pocket.

(d) To provide a closure which will not be lumped inside the pocket.

Further objects and advantages are to provide a convenient way to carry lot of keys without getting lumped shape and damage the pocket.

DRAWING FIGURES

In the drawings, closely related figures have the same number but different alphabetic suffixes FIGS. 1-A and 1-B show the inner cylinder from two different views.

FIG. 2 shows the outer cylinder with smaller diameter in one end.

FIG. 3-A shows a penholder "4".

FIG. 3-B shows the key rings "5".

DESCRIPTION

FIG. 1-A shows a cylinder with hole (2) in the bottom end, to install key ring. Meanwhile the other end has bigger diameter to grip with the outer cylinder (1).

FIG. 1-B shows the side view with a long split (3) through the length of cylinder to provide movement of outer cylinder key ring.

FIG. 2 shows the outer cylinder with smaller diameter in one end (1) and is used to hold the inner cylinder; hole in this cylinder is marked by number 2.

The other side of this cylinder is used to attach a pen holder (3). This gives possibility of carrying them inside pocket (especially designed for pant pocket). The crucial idea here is, hanging keys without spread them out through the pockets. In fact they keep tight in the corner of pant pocket and even during running they will not moving up and down to make inconvenience.

Advantages

From description above, number of advantages of my key holder become evident.

(a) It is easy for manufacturer to produce in different sizes, shape, color and materials (polyethylene, polypropylene, metal or even leather).

(b) It has beautiful shape, and is light to handle it.

(c) It is easy to fix in pant pocket.

(d) Cylinders moving together which make easy access to the keys in both end of each cylinder.

Operation—FIGS. 3-A and 3-B

These two figures show that how two cylinders move in each other to bring the two key ring holes close to each other and consequently easy access to keys in upper and lower cylinder (or outer and inner cylinders). They are easily move together and separating from each other, even with a lot of keys attached to them.

Conclusion, ramification and scope

Accordingly, the reader will see that the key holder closure of this invention can be used to distribute the keys within total height of pocket. Easy adjust in corner side of pocket with attach a pen holder to upper cylinder.

It is easy to put and remove from pocket.

It is easy to operate with moving two cylinders together.

It is easy to produce in different size, color and materials.

The most important point of this invention is, to get rid of lumped keys inside the pockets.

I claim:

1. A key holder comprising:

an inner cylinder slidable within an outer cylinder, a key ring hole in one end of each cylinder, a key ring in the inner cylinder hole, a key ring in the outer cylinder hole, a longitudinal slot in a side wall of said inner cylinder extending a substantial length of said inner cylinder, the key ring in the outer cylinder hole being received in and sliding along said longitudinal slot as the inner cylinder slides within the outer cylinder.

2. The holder of claim 1, further comprising a pen-type pocket holder.

* * * * *